US011787074B2

(12) United States Patent
Gratsias et al.

(10) Patent No.: US 11,787,074 B2
(45) Date of Patent: Oct. 17, 2023

(54) MECHANICAL ASSEMBLY OF A SKIN CARE DEVICE, SKIN CARE DEVICE AND PROCESS FOR MANUFACTURING THEREOF

(71) Applicant: Bic Violex S.A., Anoixi (GR)

(72) Inventors: Spyridon Gratsias, Athens (GR); Ioannis Bozikis, Athens (GR); Panagiotis Kopelas, Dafni (GR)

(73) Assignee: BIC Violex Single Member S.A., Anoixi (GR)

( * ) Notice: Subject to any disclaimer, the term of this patent is extended or adjusted under 35 U.S.C. 154(b) by 196 days.

(21) Appl. No.: 16/940,796

(22) Filed: Jul. 28, 2020

(65) Prior Publication Data

US 2021/0031391 A1 Feb. 4, 2021

(30) Foreign Application Priority Data

Jul. 31, 2019 (EP) ..... 19189392

(51) Int. Cl.
*B26B 21/52* (2006.01)
*B26B 21/40* (2006.01)
*B26B 21/22* (2006.01)

(52) U.S. Cl.
CPC ..... *B26B 21/521* (2013.01); *B26B 21/225* (2013.01); *B26B 21/4075* (2013.01)

(58) Field of Classification Search
CPC ..... B26B 21/225; B26B 21/4012; B26B 21/4068; B26B 21/4075; B26B 21/521
(Continued)

(56) References Cited

U.S. PATENT DOCUMENTS 4,213,240 A * 7/1980 Ferraro ..... B26B 21/521 30/47
4,411,065 A * 10/1983 Trotta ..... B26B 21/521 30/47

(Continued)

FOREIGN PATENT DOCUMENTS

EP 1115537 B1 7/2006
EP 3461604 A1 4/2019

(Continued)

OTHER PUBLICATIONS

European Search Report in EP 19189392.4 dated Dec. 16, 2019, (8 pages).

*Primary Examiner* — Jason Daniel Prone
(74) *Attorney, Agent, or Firm* — Bookoff McAndrews, PLLC

(57) ABSTRACT

A kit of incompatible skincare devices may include a connector assembly for connecting a head and a handle of a skincare device to one another. The connector assembly may include a first positioning element connected to a mechanical assembly of the connector assembly and a second positioning element connected to an adaptor of the connector assembly. The mechanical assembly may be insertable in the adaptor along an insertion direction and engageable to the adaptor when the first and second positioning elements correspond to one another. The adaptor may extend along the insertion direction from the second positioning element. The mechanical assembly may extend along the insertion direction from the first positioning element. The first and second positioning elements may be configured to interfere with engagement of the mechanical assembly to the adaptor when the first and second positioning elements do not correspond to one another.

11 Claims, 7 Drawing Sheets

(58) Field of Classification Search
USPC ..... 30/47–51, 526–536
See application file for complete search history.

(56) References Cited

U.S. PATENT DOCUMENTS

| | | | | | |
|---|---|---|---|---|---|
| 4,413,411 | A * | 11/1983 | Trotta | B26B 21/521 | 30/526 |
| 4,422,237 | A * | 12/1983 | Trotta | B26B 21/521 | 30/526 |
| 4,446,619 | A * | 5/1984 | Jacobson | B26B 21/521 | 30/47 |
| 4,599,793 | A * | 7/1986 | Iten | B26B 21/225 | 30/47 |
| 5,070,614 | A * | 12/1991 | Hardin | B26B 21/521 | 30/527 |
| 5,093,991 | A * | 3/1992 | Hendrickson | B26B 21/521 | 30/531 |
| 5,469,621 | A * | 11/1995 | Alsept | B26B 21/4068 | 30/50 |
| 5,956,851 | A * | 9/1999 | Apprille, Jr. | B26B 21/521 | 30/526 |
| 7,162,802 | B2 * | 1/2007 | Benardeau | A47G 21/02 | 30/147 |
| 9,669,555 | B2 * | 6/2017 | Griffin | B26B 21/225 | |
| D807,582 | S * | 1/2018 | Christofidellis | B26B 21/4012 | D28/48 |
| D808,590 | S * | 1/2018 | Christofidellis | B26B 21/225 | D28/48 |
| D813,456 | S * | 3/2018 | Christofidellis | B26B 21/225 | D28/48 |
| 11,007,661 | B2 * | 5/2021 | Mazarakis | B26B 21/521 | |
| 2001/0039739 | A1 * | 11/2001 | Ferraro | B26B 21/521 | 30/526 |
| 2005/0000100 | A1 * | 1/2005 | Coffin | B26B 21/225 | 30/531 |
| 2005/0223568 | A1 * | 10/2005 | Walker | B26B 21/225 | 30/50 |
| 2009/0056140 | A1 * | 3/2009 | Bruno | B26B 21/225 | 30/40 |
| 2009/0288299 | A1 * | 11/2009 | Denkert | B26B 21/225 | 30/50 |
| 2010/0313426 | A1 * | 12/2010 | Royle | B26B 21/521 | 30/84 |
| 2011/0088269 | A1 * | 4/2011 | Walker, Jr. | B26B 21/225 | 30/527 |
| 2013/0312265 | A1 * | 11/2013 | Wilson | B26B 21/225 | 30/51 |
| 2014/0116211 | A1 * | 5/2014 | Griffin | B26B 21/225 | 30/47 |
| 2015/0217466 | A1 * | 8/2015 | Leicht | B26B 21/4075 | 30/50 |
| 2016/0101531 | A1 | 4/2016 | Bunnell | | |
| 2016/0193740 | A1 * | 7/2016 | Phillips | B26B 21/521 | 30/34.05 |
| 2017/0001323 | A1 * | 1/2017 | Furuta | B26B 21/225 | |
| 2017/0087732 | A1 * | 3/2017 | Metcalf | B26B 21/521 | |
| 2017/0113363 | A1 * | 4/2017 | Lopez | B26B 21/521 | |
| 2017/0217034 | A1 * | 8/2017 | Lessmann | B26B 21/4068 | |
| 2017/0217035 | A1 * | 8/2017 | Treu | B26B 21/225 | |
| 2017/0326741 | A1 * | 11/2017 | Liberatore | B26B 21/4012 | |
| 2017/0341248 | A1 * | 11/2017 | Lee | B26B 21/225 | |
| 2017/0341249 | A1 * | 11/2017 | Lee | B26B 21/521 | |
| 2018/0297224 | A1 * | 10/2018 | Bozikis | B26B 21/225 | |
| 2019/0176355 | A1 * | 6/2019 | Mazarakis | B26B 21/225 | |
| 2019/0224873 | A1 * | 7/2019 | Han | B26B 21/521 | |
| 2019/0255721 | A1 * | 8/2019 | Psimadas | B26B 21/521 | |
| 2019/0299467 | A1 * | 10/2019 | Bassett | B26B 21/225 | |
| 2020/0156274 | A1 * | 5/2020 | Georgakis | B26B 21/225 | |
| 2020/0180177 | A1 * | 6/2020 | Bunnell | B26B 21/521 | |
| 2021/0008745 | A1 * | 1/2021 | Kruemke | B26B 21/521 | |
| 2021/0122072 | A1 * | 4/2021 | Ntavos | B26B 21/521 | |
| 2021/0129365 | A1 * | 5/2021 | Kopelas | B26B 21/521 | |
| 2021/0170616 | A1 * | 6/2021 | Avery | B26B 21/522 | |
| 2021/0186180 | A1 * | 6/2021 | Kosloff | A45D 34/00 | |
| 2021/0187768 | A1 * | 6/2021 | Lee | B26B 21/521 | |
| 2021/0187769 | A1 * | 6/2021 | Kopelas | B26B 21/225 | |
| 2021/0339416 | A1 * | 11/2021 | Kopelas | B26B 21/521 | |
| 2021/0379777 | A1 * | 12/2021 | Kopelas | B26B 21/521 | |
| 2022/0118636 | A1 * | 4/2022 | Kallivretaki | B26B 21/521 | |

FOREIGN PATENT DOCUMENTS

| | | | | |
|---|---|---|---|---|
| EP | 3944935 | A1 * | 2/2022 | B26B 21/521 |
| WO | WO 9737819 | A2 | 10/1997 | |
| WO | WO 9836878 | A2 | 8/1998 | |
| WO | WO 2018/007844 | A1 | 1/2018 | |

* cited by examiner

[Fig. 1]
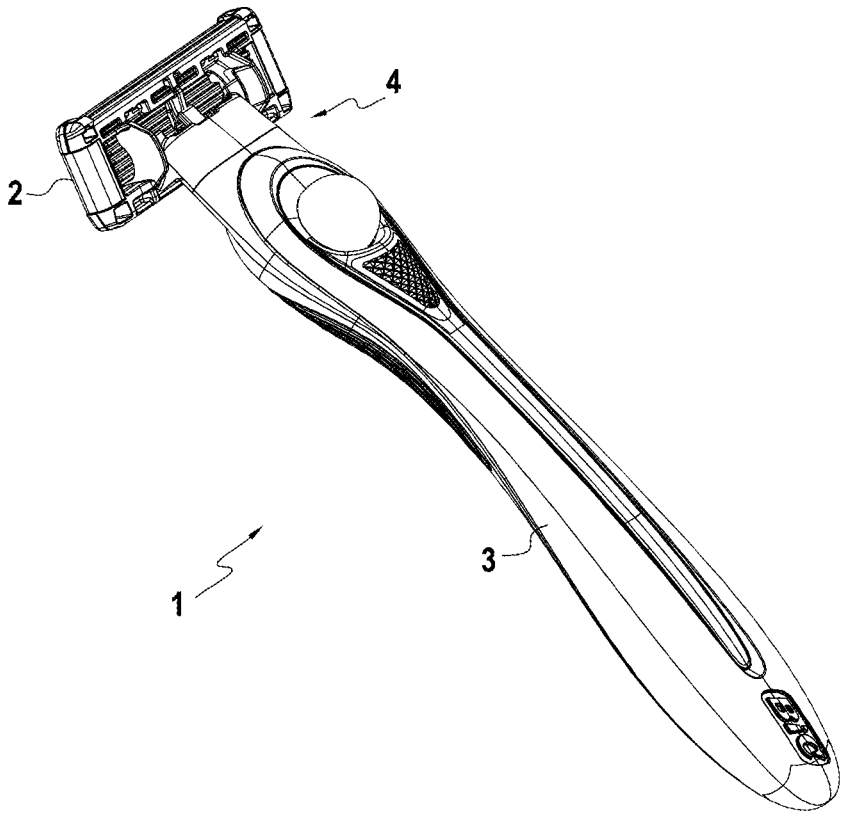

[Fig. 3]
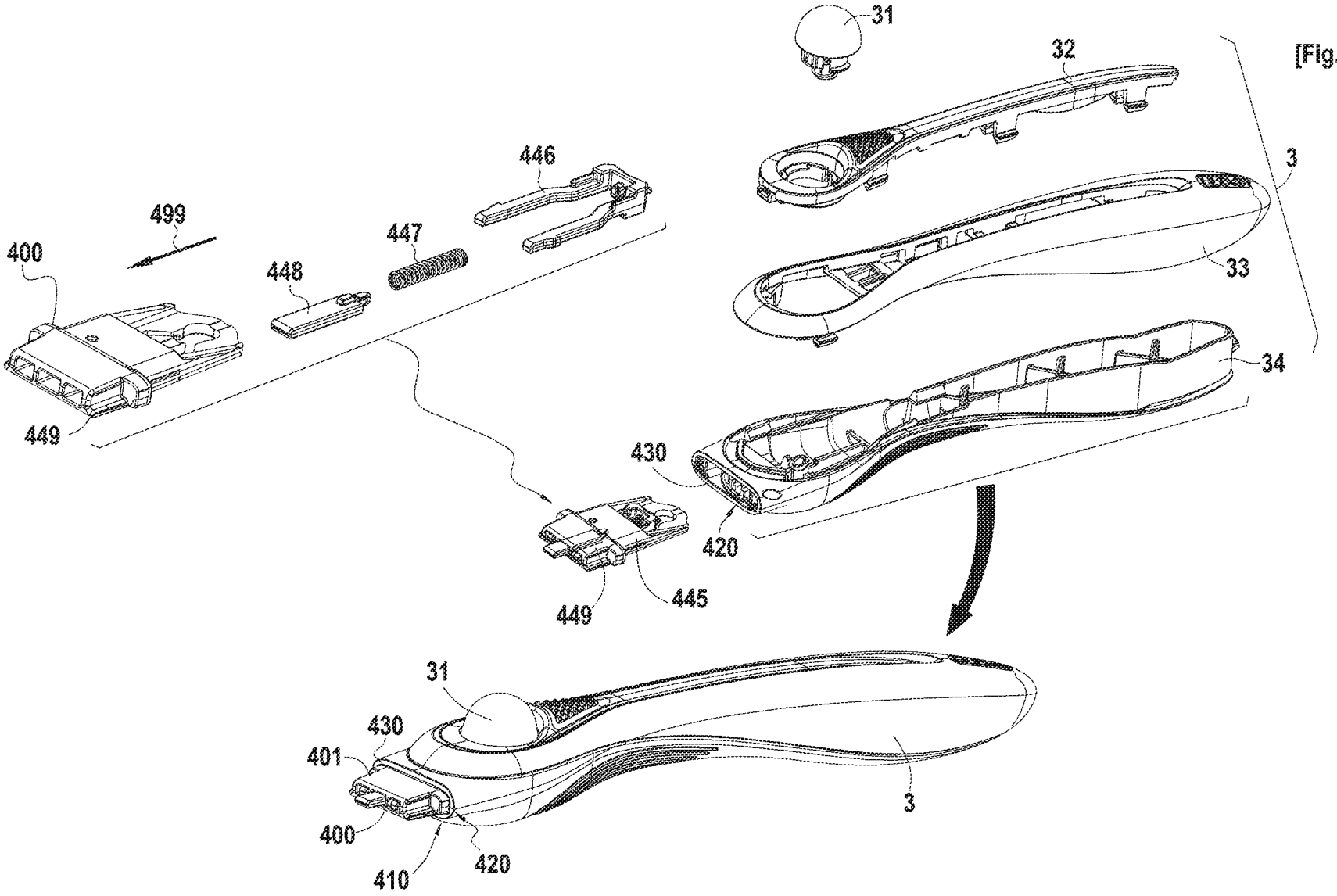

[Fig. 4]
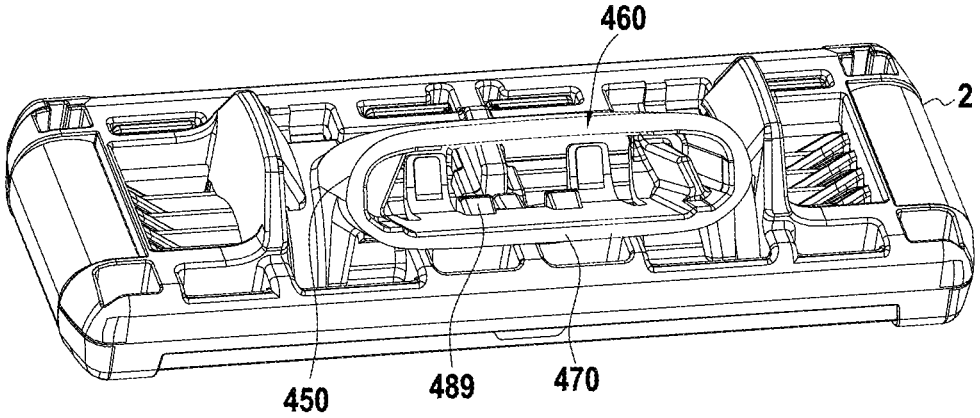

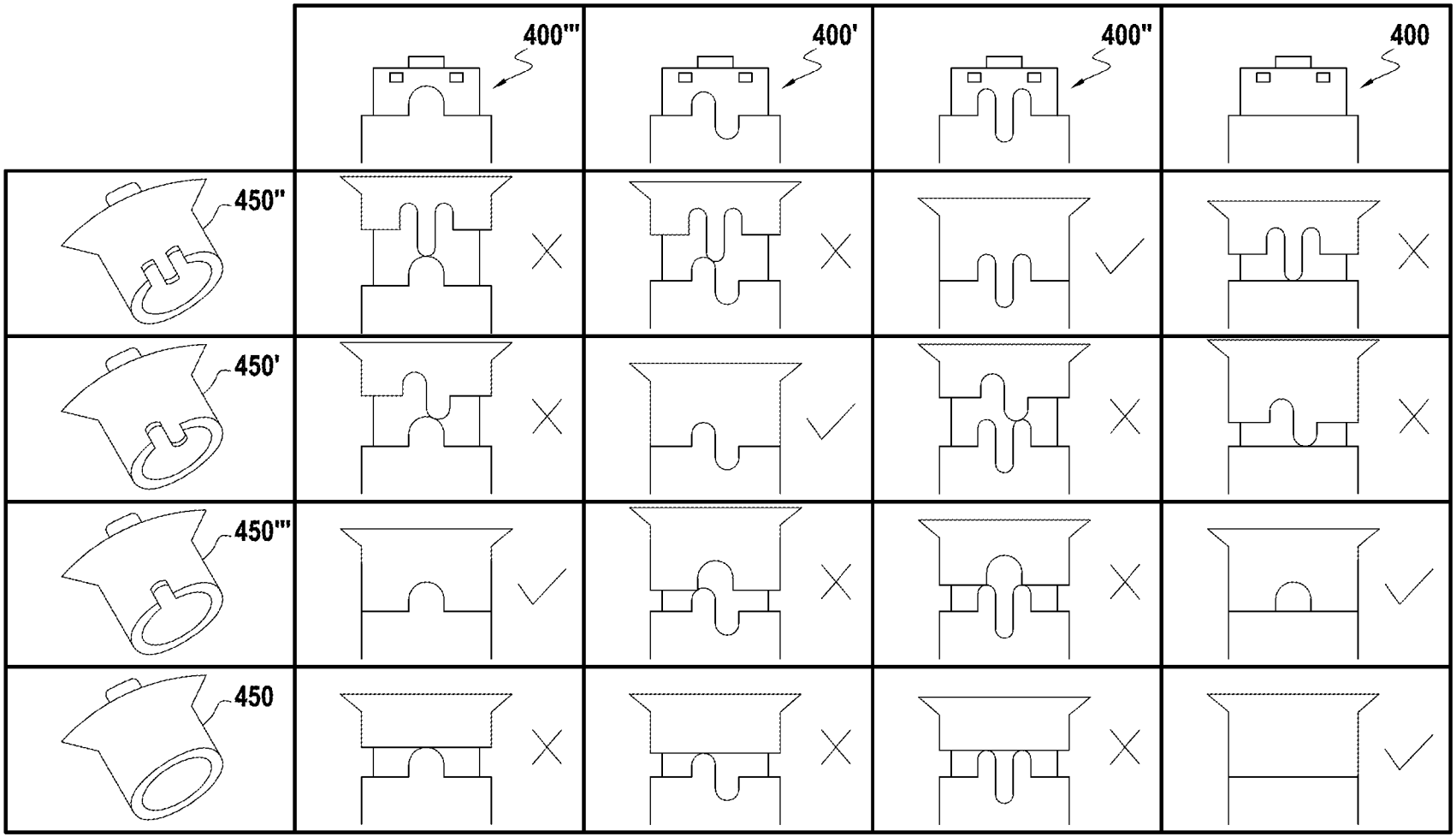
[Fig. 5]

MECHANICAL ASSEMBLY OF A SKIN CARE DEVICE, SKIN CARE DEVICE AND PROCESS FOR MANUFACTURING THEREOF

CROSS REFERENCE TO RELATED APPLICATION(S)

This application claims priority to European Application No. EP19189392.4, filed on Jul. 31, 2019, the entirety of which is incorporated herein by reference.

FIELD

The present disclosure relates to the field of skincare, and in particular to shaving. More specifically, the present disclosure relates to a razor connector assembly for connecting a head to a handle of a skincare device. In particular processes of manufacturing incompatible skin care devices and kits are disclosed.

BACKGROUND ART

It is known to connect the head to a handle of a skincare device by means of a connector assembly comprising a mechanical assembly and an adaptor, so that a user may, for example, conserve a handle portion of the skincare device and replace the head portion of the skincare device. If the portion of the connector assembly attached to the new head matches the connector assembly portion attached to the handle, then the user may be able to connect the head to the handle and use the skincare device with replacement head, regardless of whether the handle and the new head were intended to be used together or not.

SUMMARY

It has been recognized that it may be desirable to provide multiple, incompatible product lines that share between them matching mechanical assemblies and/or adaptors.

To that end embodiments of the present disclosure provide for a process for manufacturing incompatible skincare devices, comprising fabricating a first skincare device comprising a head, a handle, and a connector assembly for connecting the head to the handle, and fabricating a second skincare device comprising a head, a handle, and a connector assembly for connecting the head to the handle. Each connector assembly may include a mechanical assembly coupled to one of the head or the handle and an adaptor coupled to the other of the head or the handle. The first skincare device includes a first arrangement of first and second positioning elements which correspond to one another. The second skincare device includes a second arrangement of first and second positioning elements which correspond to one another. The mechanical assembly of the first skincare device is insertable into the adaptor of the second skincare device. The first and second arrangements of first and second positioning elements differ from one another such that at least one of the first positioning element of the first skincare device and the second positioning element of the second skincare device interferes with engagement of the mechanical assembly of the first skincare device to the adaptor of the second skincare device.

According to examples of the present disclosure, the first arrangement may include a first pair of positioning features which are geometrically compatible with one another. The second arrangement may include a second pair of positioning features which are geometrically compatible with one another. At least one feature from the first pair of positioning features may be geometrically compatible with at least one feature from the second pair of positioning features.

According to examples of the present disclosure, the first and second pairs of positioning features may be provided respectively at relative locations with respect to the connector assemblies of the first and second skincare devices which differ from each other.

According to examples of the present disclosure, at least one positioning feature attached to the first positioning element of the first skincare device may be geometrically compatible with at least one positioning feature attached to the first positioning element of the second skincare device.

According to examples of the present disclosure, the first positioning element of the second arrangement may be geometrically compatible with the first positioning element of the first arrangement. Additionally or alternatively, the second positioning element of the second arrangement may be geometrically compatible with the second positioning element of the first arrangement.

To that end, also a kit comprising a first skin care device and a second skin care device may be provided. The first and second skin care device comprise a connector assembly for connecting a head and a handle of each skincare device to one another, for example, of a razor or a shaver. The connector assembly comprises a first positioning element connected to a mechanical assembly of the connector assembly. The connector assembly comprises a second positioning element connected to an adaptor of the connector assembly. The mechanical assembly is insertable in the adaptor along an insertion direction. The mechanical assembly is engageable to the adaptor when the first and second positioning elements correspond to one another. The adaptor extends along the insertion direction towards the head and/or from the second positioning element. The mechanical assembly extends along the insertion direction from the first positioning element and/or from the handle. The first and second positioning elements are configured to interfere with engagement of the mechanical assembly to the adaptor when the first and second positioning elements do not correspond to one another.

According to examples of the present disclosure, the mechanical assembly may be removably engageable to the adaptor when the first and second positioning elements correspond to one another.

According to examples of the present disclosure, the second positioning element may be arranged on a transverse surface of the adaptor. The transverse surface of the adaptor may be arranged transverse to the insertion direction such that the mechanical assembly extends beyond the transverse surface of the adaptor in the insertion direction during insertion of the mechanical assembly into the adaptor.

According to examples of the present disclosure, the first and second positioning elements may be at least partially insertable into one another along the insertion direction when corresponding to one another.

According to examples of the present disclosure, a first portion of the mechanical assembly may be insertable into a first portion of the adaptor when the first and second positioning elements correspond to one another. A second portion of the adaptor may be configured to contact the first portion of the mechanical assembly guidingly when the first and second positioning elements are not contacting each other.

According to examples of the present disclosure, a skincare device may be provided. The skincare device may comprise a connector assembly as described herein.

According to examples of the present disclosure, the connector assembly or skincare device may comprise a mechanical assembly housing. The mechanical assembly may be inserted in the mechanical assembly housing. The first positioning element may include a transverse surface of the mechanical assembly housing. The transverse surface of the mechanical assembly housing may be arranged transverse to the insertion direction. The transverse surface of the mechanical assembly housing may face the adaptor during insertion of the mechanical assembly into the adaptor.

According to examples of the present disclosure, the mechanical assembly housing may be provided on the handle of the skincare device.

According to examples of the present disclosure, the first positioning element may be arranged on a peripheral surface of the mechanical assembly.

According to examples of the present disclosure, the peripheral surface of the mechanical assembly may be an outer peripheral surface of the mechanical assembly.

According to examples of the present disclosure, the first positioning element may be bonded to or integrated with at least one of the mechanical assembly and the mechanical assembly housing.

According to examples of the present disclosure, a skincare device as described earlier herein may be fabricated according to a process comprising providing a mechanical assembly connected a handle, and an adaptor connected to a head, connecting a first positioning element to the mechanical assembly and/or to the handle, and connecting a second positioning element to the adaptor and/or to the head such that the first and second positioning elements correspond to one another.

Additionally or alternatively, such a skincare device may be fabricated according to a process comprising providing the adaptor with a positioning element having a first geometry and being arranged at a first location of the adaptor, and providing the mechanical assembly with the second positioning element, the second positioning element having a second geometry and a second location, wherein the second geometry and the second location are defined as a function of the first geometry and the first location such that they correspond to one another.

Additionally or alternatively, such a skincare device may be fabricated according to a process comprising providing a mechanical assembly connected to a handle and an adaptor connected to a head, providing a first positioning feature connected to the mechanical assembly, providing a second positioning feature connected to the adaptor, and inserting the mechanical assembly in the adaptor such that the first and second positioning elements guide insertion and connection between the head and the handle.

According to examples of the present disclosure, such a process for manufacturing incompatible skincare devices may comprise a process as disclosed herein for fabricating a skincare device.

According to examples of the present disclosure, a process for fabricating a head for such a skincare device may be provided. Such a process may be a process for fabricating a head for a handle of the skincare device. The process may comprise providing the head with a positioning element connected to the head. The positioning element connected to the head may have a first geometry and be arranged at a first location. The first location may be a relative location with respect to the head. The process may comprise determining the first geometry and the first location on the basis of a second geometry and a second location, which may be a geometry and a location relative to the handle of a positioning element connected to the handle, such that the positioning element connected to the head and the positioning element connected to the handle correspond to one another.

BRIEF DESCRIPTION OF THE DRAWINGS

The disclosure may be more completely understood in consideration of the following detailed description of aspects of the disclosure in connection with the accompanying drawings, in which:

FIG. 1 shows an exemplary skincare device.

FIG. 3 shows an exemplary mechanical assembly and an exemplary handle.

FIG. 4 shows an exemplary adaptor and an exemplary head.

FIG. 5 shows exemplary mechanical assemblies and exemplary adaptors.

Figure 2A:
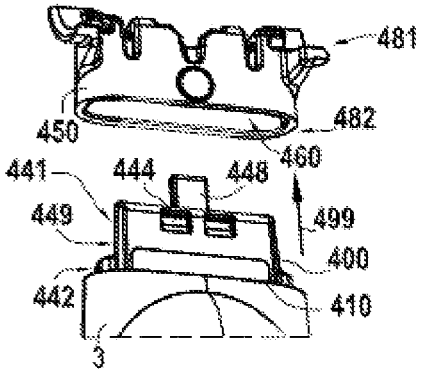
FIG. 2A shows an exemplary connector assembly.

The term "exemplary" is used in the sense of "example," rather than "ideal." While aspects of the disclosure are amenable to various modifications and alternative forms, specifics thereof have been shown by way of example in the drawings and will be described in detail. It should be understood, however, that the intention is not to limit aspects of the disclosure to the particular embodiment(s) described. On the contrary, the intention of this disclosure is to cover all modifications, equivalents, and alternatives falling within the scope of the disclosure.

DETAILED DESCRIPTION

As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise.

The following detailed description should be read with reference to the drawings. The detailed description and the drawings, which are not necessarily to scale, depict illustrative aspects and are not intended to limit the scope of the disclosure. The illustrative aspects depicted are intended only as exemplary.

FIG. 1 shows a skincare device 1 according to an example of the present disclosure. The skincare device may include a head 2, a handle 3 and a connector assembly 4 for connecting the head 2 and the handle 3 to one another.

As seen in FIG. 2A, the connector assembly 4 may include a mechanical assembly 400 and an adaptor 450 into which the mechanical assembly 400 may be insertable along an insertion direction 499. The mechanical assembly 400 may be connected to or included in the handle 3 and the adaptor 450 may be connected to or included in the head 2.

The mechanical assembly 400 may be connected to a first positioning element 410. The mechanical assembly 400 may extend along the insertion direction 499 from the first positioning element 410.

The adaptor 450 may be connected to a second positioning element 460. The adaptor 450 may extend along the insertion direction 499 from the second positioning element 460.

The mechanical assembly 400 and the adaptor 450 may be engageable to one another.

The mechanical assembly 400 may be retained in the adaptor 450 when they are engaged to one another.

The mechanical assembly 400 may be removably engageable to the adaptor 450 when the first positioning element 410 and the second positioning element 460 correspond to one another.

The mechanical assembly 400 may include an interface portion 449 for interfacing with the adaptor 450.

The interface portion 449 may include a recess 444 in which a protrusion 489 borne on the adaptor 450 (see FIG. 4) may penetrate during engagement of the mechanical assembly 400 and adaptor 450 to one another. Additionally or alternatively, it is envisaged to provide the protrusion 489 on the interface portion 449 and the recess 444 on the adaptor 450. In either case, penetration of the protrusion 489 in the recess 444 may occur transversally to the insertion direction 499.

As seen in FIG. 3, the mechanical assembly 400 may be mounted in the handle 3 of the skincare device. The connector assembly 4 may comprise a mechanical assembly housing 420, in which the mechanical assembly 400 is inserted. The mechanical assembly housing 420 may be provided on the handle 3. As a non-limiting example, the mechanical assembly housing 420 may be integrated with the handle 3.

The mechanical assembly 400 may comprise an anchoring portion 445 for being embedded in the mechanical assembly housing 420. The anchoring portion 445 may be connected to the interface portion 449 such that the interface portion 449 of the mechanical assembly 400 may extend along the insertion direction 499 from the mechanical assembly housing 420 when the anchoring portion 445 is embedded therein.

The mechanical assembly 400 may include a releasing mechanism 446 which is actionable to disengage the head from the handle 3. For example, the releasing mechanism 446 may be mobile with respect to the interface portion 449. The releasing mechanism 446 may be at least partially mounted within the interface portion 449, for example.

As a non-limiting example, the releasing mechanism 446 may be made to disengage the adaptor 450 from the mechanical assembly 400 by reducing penetration of the protrusion 489 within the recess 444, or even by removing the protrusion 489 from the recess 444.

As a non-limiting example, the docking assembly may be mountable within the mechanical assembly housing 420 as a single unit and/or in a single mounting step. In examples, the mechanical assembly 400 may include a pusher 448 that is configured to facilitate the pivoting of the head 2 relative to the handle 3. The pusher 448 may, for example, extend further than the interface portion 449 in the insertion direction 499 towards the adaptor 450 when the mechanical assembly 400 is not engaged to the adaptor 450 (see FIG. 2A, for example).

The pusher 448 may be mobile with respect to the interface portion 449. The pusher 448 may be mounted within the interface portion 449, for example.

Returning now to FIG. 3, it can be seen that the mechanical assembly may include a resilient member 447. The resilient member 447 may be configured to bias the pusher 448 in the insertion direction 499. The adaptor 450 may include a passageway through which the pusher 448 is able to contact the head 2 so as to bias the head 2 in rotation relative to the adaptor 450. Additionally or alternatively, the resilient member 447 may be configured to bias the releasing mechanism 446 away from disengaging the adaptor from the mechanical assembly 400.

As seen in FIGS. 2A-7D, engageability of a given mechanical assembly 400, 400', 400", 400'" and a given adaptor 450, 450', 450", 450- to one another may depend on possible interactions between their respective positioning elements.

When a given first positioning element and a given second positioning element do not interfere with engagement of their respective mechanical assembly and adaptor to one another, the first and second positioning elements are said to be corresponding to one another. Non-limiting examples of corresponding first 410, 410', 410", 410'", and second 460, 460', 460", 460'", 460'" positioning elements may be visible in FIGS. 2A-2C, FIG. 5 (column 1 row 3, column 2 row 2, column 3 row 1, column 4 rows 1-4), FIGS. 6A-6B & 6D and FIGS. 7A-7B.

However, when a given first positioning element and a given second positioning element do not correspond to one another, at least one of them may interfere with engagement their respective mechanical assembly and adaptor to one another. Non-limiting examples of non-corresponding first 410, 410', 410", 410'", 410"", 416 and second 460, 460', 460", 460'", 460"", 461 positioning elements may be visible in FIG. 5 (column 1 rows 1-2 & 4, column 2 rows 1 & 3-4, column 3 rows 2-4) and FIGS. 6C & 7C-7D.

When corresponding positioning elements are made to contact one another during engagement of their respective mechanical assembly 400, 400', 400", 400'" and adaptor 450, 450', 450", 450'" to one another, the contact may be described as cooperative. However, according to some examples of the present disclosure, corresponding positioning elements may be out of contact with each other (entirely or partially) when their respective mechanical assembly 400, 400', 400", 400'" and adaptor 450, 450', 450", 450'" are engaged to one another.

Figure 2B:
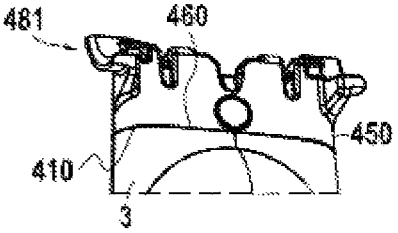
FIG. 2B shows the connector assembly of FIG. 2A.
Figure 2C:
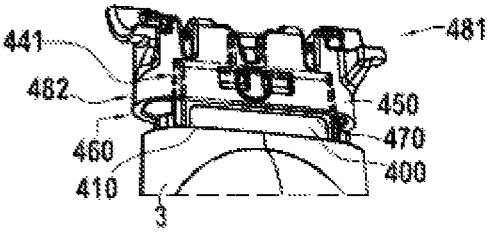
FIG. 2C shows the connector assembly of FIG. 2A.

As seen in FIG. 2C, for example, first positioning element 410 (connected to mechanical assembly 400) and second positioning element 460 (connected to adaptor 450) can be considered to be contacting each other cooperatively because the mechanical assembly 400 is engageable to the adaptor 450 while the first 410 and second 460 positioning elements are in contact with each other.

As seen in FIGS. 2A-2C, FIG. 5 (column 1 row 3, column 2 row 2, column 3 row 1, column 4 rows 1-4), FIGS. 6A-6B & 6D, FIGS. 7A-7B, a first positioning element 410, 410', 410", 410'" and a second positioning element 460, 460', 460", 460'" may be considered to correspond to one another when they do not interfere with engagement of their respective mechanical assembly 400, 400', 400", 400'" and adaptor 450, 450', 450" 450- to one another.

For example, as seen in FIGS. 2A-2C, first positioning element 410 and second positioning element 460 can be considered to correspond to one another because they are able to contact one another cooperatively.

As seen in FIG. 5, first positioning element 410' and second positioning element 460' (of connector assembly 4', which comprises mechanical assembly 400' and adaptor 450') correspond to one another, as do first positioning element 410" and second positioning element 460" (of connector assembly 4", which comprises mechanical assembly 400" and adaptor 450"), and first positioning element 410'" and second positioning element 460'" (of connector assembly 4''', which comprises mechanical assembly 400''' and adaptor 450'''), since they do not contact each other interferingly.

When the first positioning element 410, 410', 410'', 410''' and the second positioning element 460, 460', 460'', 460''' correspond to one another, insertion of the mechanical assembly 400, 400', 400'', 400''' along the insertion direction 499 into the adaptor 450, 450', 450'', 450''' may cause the first positioning element 410, 410', 410'', 410''' and the second positioning element 460, 460', 460'', 460''' to contact one another cooperatively.

When the first positioning element 410, 410', 410'', 410''' and the second positioning element 460, 460', 460'', 460''' do not correspond to one another, they may be configured to interfere with engagement of the mechanical assembly 400, 400', 400'', 400''' to the adaptor 450, 450', 450'', 450'''.

For example, first positioning element 410' does not correspond to second positioning element 460 or second positioning element 460'' or second positioning element 460''' because the first positioning element 410' contacts these second positioning elements 460, 460'', 460''' interferingly during insertion of the mechanical assembly 400' into these adaptors 450, 450'', 450'''. The same is true for first positioning element 410'' and second positioning elements 460, 460' and 460''' with regard to mechanical assembly 400'' and adaptors 450, 450' and 450''', and for first positioning element 410''' and second positioning elements 460, 460' and 460'' with regard to mechanical assembly 400''' and adaptors 450, 450' and 450''.

In contrast, first positioning element 410 can be considered to correspond to each of second positioning elements 460', 460'' and 460''' since they do not contact each other interferingly during insertion of the mechanical assembly 400 into these adaptors 450', 450'', 450'''.

As seen in FIGS. 2A-2C, a first portion 441 of the mechanical assembly 400 (visible in FIG. 2A) may be insertable into a first portion 481 of the adaptor 450 when the first 410 and second 460 positioning elements correspond to one another (visible in FIG. 2B). As a non-limiting example, the first portions 481, 441 of the adaptor 450 and mechanical assembly 400 may comprise the recess 444 and the protrusion 489, respectively or vice versa.

A second portion 482 of the adaptor 450 may be configured to contact the first portion 441 of the mechanical assembly 400 guidingly when the mechanical assembly 400 is inserted in the adaptor 450 and the first 410 and second 460 positioning elements are not cooperatively contacting each other (see FIG. 2C).

Figure 6A:
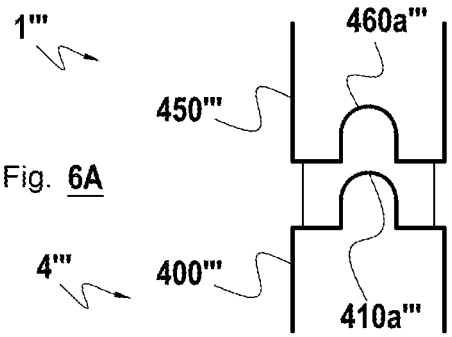
FIGS. 6A-6D show exemplary mechanical assemblies and exemplary adaptors.
Figure 6B:
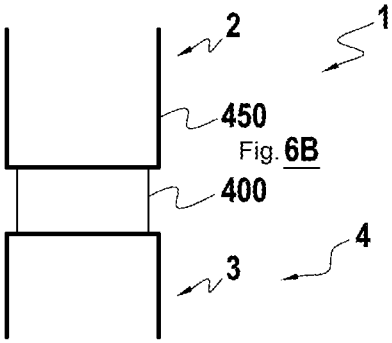
Figure 6C:
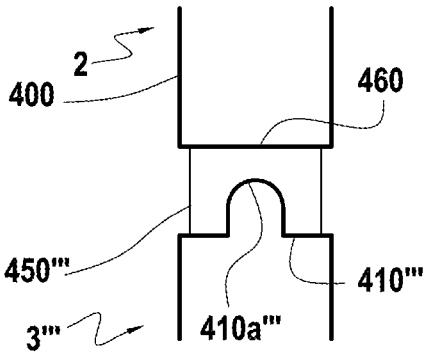

When corresponding positioning elements are configured to contact one another cooperatively, this guiding contact between the second portion 482 of the adaptor 450 and the first portion 441 of the mechanical assembly may help to guide the corresponding positioning elements into cooperative contact with one another, as seen in FIG. 6A, for example. Additionally or alternatively, as seen in FIG. 6C, for example, this guiding contact may help to guide non-corresponding positioning elements (such as first positioning element 410''' and second positioning element 460) into interfering contact with one another.

Returning now to FIG. 2A, it can be seen that the second positioning element 460 may be arranged nearer the second portion 482 of the adaptor 450 than the first portion 481 of the adaptor 450.

The first positioning element 410 may be located nearer a second portion 442 of the mechanical assembly 400 than the first portion 441 of the mechanical assembly 400. The first portion 441 of the mechanical assembly 400 may extend further in the insertion direction 499 than the second portion 442 of the mechanical assembly 400.

As seen in FIG. 3, when the mechanical assembly 400 is connected to the handle 3, the handle 3 may also be connected to a button 31 or other device for actuating the releasing mechanism 446. The mechanical assembly housing 420 may provide an opening through which the mechanical assembly may be situated so as to interact with the button 31.

The handle may include an assembly of multiple handle pieces 32, 33, 34, or may be monolithic.

It may be understood that a first positioning element 410, provided on the handle 3 of a skincare device, may be considered to be connected to the mechanical assembly 400 of the skincare device when the handle 3 comprises (or is connected to) the mechanical assembly 400. Likewise, it may be understood that a second positioning element 460 provided on the head of a skincare device may be considered to be connected to the adaptor 450 of the skincare device when the head comprises (or is connected to) the adaptor 450.

As seen in FIG. 4, the head 2 may be a skincare head such as a shaving head. In this regard, the skincare device may be considered to be a razor or shaver. Other non-limiting examples of skincare heads include exfoliation heads, brush heads, massage heads, etc. The shaving head may include a razor cartridge, for example.

The head 2 may, as a non-limiting example, be pivotable with respect to the adaptor 450 and/or fixable in rotation with respect to the adaptor 450.

The second positioning element 460 may be provided with a transverse surface 470 which is arranged transverse to the insertion direction 499. As a non-limiting example, the transverse surface 470 may be a surface of the adaptor 450.

As seen in FIGS. 2B-2C, the mechanical assembly 400 may extend beyond the transverse surface 470 in the insertion direction 499 during insertion of the mechanical assembly 400 into the adaptor 450.

Additionally, or alternatively, the transverse surface 470 may face the second portion of the mechanical assembly 442 during insertion of the mechanical assembly 400 into the adaptor 450.

Returning to FIG. 3, it may be seen that the first positioning element 410 may be provided with a transverse surface 430 which is arranged transverse to the insertion direction 499. As seen in FIG. 2C, the transverse surface 430 may be arranged to face the adaptor 450 during insertion of the mechanical assembly 400 into the adaptor 450.

When the transverse surfaces 430, 470 contact each other interferingly, they may block further insertion of the mechanical assembly 400 into the adaptor 450.

Additionally or alternatively, the first positioning element 410 may bonded to or integrated with the mechanical assembly housing 420. For example, as seen in FIG. 3, the transverse surface 430 may be a surface of the mechanical assembly housing 420. When the mechanical assembly housing 420 is provided on the handle 3, it may be understood that the handle 3 comprises the first positioning element 410.

Additionally or alternatively, the first positioning element 410 may be arranged on a peripheral surface 401 of the mechanical assembly 400, for example an outer peripheral surface of the mechanical assembly.

Additionally or alternatively, the first positioning element 410 may be bonded to or integrated with the mechanical assembly 400.

As a non-limiting example, it is foreseen for a first positioning element 410 comprised by the handle 3 to also be bonded to the mechanical assembly 400. Alternatively it is also foreseen, as a non-limiting example, to arrange the first positioning element 410 entirely on the outer peripheral surface of the mechanical assembly.

FIG. 5 includes representations of four exemplary connector assemblies: connector assembly 4 (comprising mechanical assembly 400 and adaptor 450), connector assembly 4' (comprising mechanical assembly 400' and adaptor 450'), connector assembly 4" (comprising mechanical assembly 400" and adaptor 450"), and connector assembly 4''' (comprising mechanical assembly 400''' and adaptor 450"). Each connector assembly 4, 4', 4" and 4''' has its own arrangement of first 410, 410', 410", 410''' and second 460, 460', 460", 460''' positioning elements which correspond to each other.

A given connector assembly 4, 4', 4", 4''' may be considered to have an arrangement of first 410, 410', 410", 410''' and second 460, 460', 460", 460''' positioning elements even if these positioning elements are not both directly located on the mechanical assembly 400, 400', 400", 400''' (or mechanical assembly housing 420) and adaptor 450, 450', 450", 450'''. For example, as seen in FIG. 2, first positioning element 410, which is located on the handle 3, may be considered to be connected to mechanical assembly 400 when mechanical assembly 400 is attached to handle 3. Likewise, for example second positioning element 460 located on head 2 may be considered to be connected to adaptor 450 when adaptor 450 is attached to head 2.

As seen in FIG. 5, each arrangement of first and second positioning elements may include one or more pairs positioning features 410*a'*, 460*a'*, 410*b'*, 460*b'*, 410*a"*, 460*a"*, 410*b"*, 460*b"*, 410*a'''*, 460*a'''*. However, as seen in FIG. 6B, an arrangement may also lack positioning features.

Returning now to FIG. 5, it may be seen that a pair of positioning features may include a protruding positioning feature 410*a'*, 410*b'*, 410*a"*, 410*b"*, 410*a'''* and a recessed positioning feature 460*a'*, 460*b'*, 460*a"*, 460*b"*, 460*a'''*. The members of each pair of positioning features are geometrically compatible with one another, and are provided at relative locations with respect to the mechanical assembly and adaptor that correspond to one another.

It may be understood that a protruding positioning feature and a recessed positioning feature are geometrically compatible with each other if it is possible to position them relative to each other such that they are insertable into one another, and it may be understood that they are provided at corresponding relative locations with respect to the mechanical assembly and the adaptor if it is possible to insert them into one another during engagement of the mechanical assembly and adaptor to each other. Insertion of a protruding positioning feature and a recessed positioning feature into one another may occur along the insertion direction or transverse or even perpendicular to the insertion direction.

Protruding and recessed positioning features may be arranged on either of the first and second positioning elements. Moreover, a given positioning element may bear a mixture of protruding and recessed positioning features. Positioning features may allow for a wide variety of arrangements of positioning elements to be created.

Figure 8A:
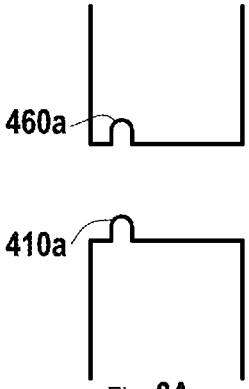
FIGS. 8A-8H show exemplary arrangements of first and second positioning elements.
Figure 8B:
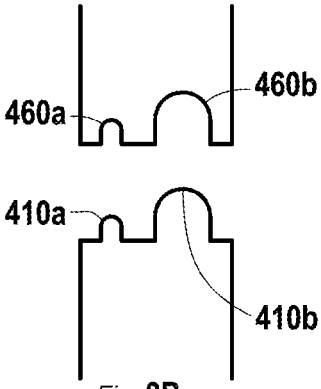

For example, as seen in FIGS. 8A-8B, an existing arrangement (for example FIG. 8A) of first and second positioning elements may serve as the basis for creating a new arrangement of first and second positioning elements by adding one or more a new pairs of positioning features (for example protruding positioning feature 410*b* and recessed positioning feature 460*b* visible in FIG. 8B) to the existing arrangement.

Figure 8C:
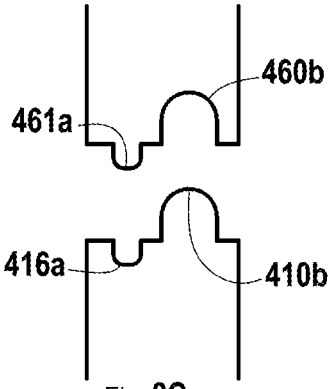

Additionally or alternatively, as seen in FIGS. 8B-8C for example, an existing arrangement first and second positioning figures may serve as the basis for creating a new arrangement of first and second positioning elements by reversing an orientation of the pair of positioning features from the existing arrangement, for example such that, the positioning feature attached to the first positioning element in the existing arrangement and the positioning feature attached to the second positioning element in the existing arrangement are attached respectively to the second and first positioning elements in the new arrangement (for example protruding positioning feature 461*a* and recessed positioning feature 416*a* visible in FIG. 8C are respectively identical to protruding positioning feature 410*a* and recessed positioning feature 460*a* visible in FIG. 8B).

Figure 8D:
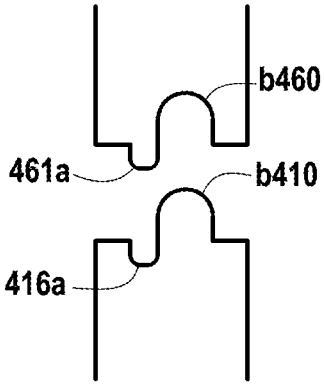

Additionally or alternatively, as seen in FIGS. 8C-8D for example, an existing arrangement of first and second positioning elements (for example FIG. 8C) may serve as the basis for creating a new arrangement of first and second positioning elements (for example FIG. 8D) by modifying the relative location of a pair of positioning features with respect to a connector assembly in an existing arrangement (for example protruding positioning features 410*b* & b410 and recessed positioning features 460*b* & b460) so that the pair of positioning features in the new arrangement has a different relative location with respect to the connector assembly than in the existing arrangement. As such, a pair of positioning features common to two arrangements may be provided at a first relative location with respect to the connector assembly in the first arrangement, and a second relative location with respect to the connector assembly in the second arrangement that is different from the first relative location.

Figure 8E:
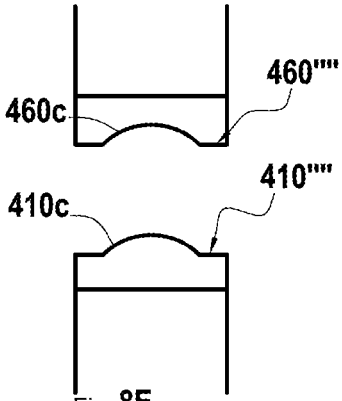

Additionally or alternatively, as seen in FIGS. 8A & 8E for example, a new arrangement of positioning elements may also be created by replacing a pair of positioning features from the an existing arrangement (for example protruding positioning feature 410*a* and recessed positioning feature 460*a* visible in FIG. 8A) with a pair of positioning features whose geometry is different from those of the existing arrangement (for example protruding positioning feature 410*c* and recessed positioning feature 460*c* visible in FIG. 8E).

Figure 8F:
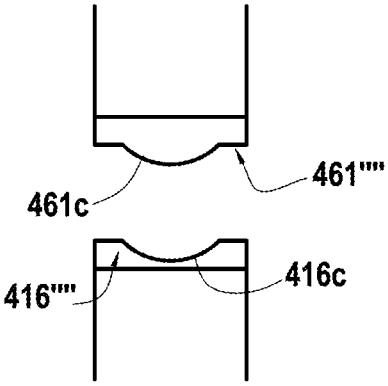
Figure 8G:
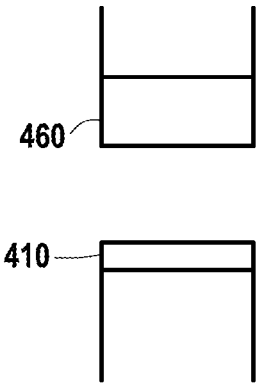

Additionally or alternatively, as seen in FIGS. 8A & 8G for example, an existing arrangement of first and second positioning elements may serve as the basis for creating a new arrangement of first and second positioning elements by removing one or more pairs of positioning features (for example recessed positioning feature 410*a* and protruding positioning feature 460*a* visible in FIG. 8A) from an existing arrangement to create a new arrangement (for example FIG. 8G).

Figure 8H:
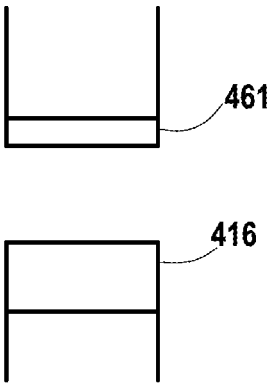

Additionally or alternatively, as seen in FIGS. 8G-8H for example, an existing arrangement of positioning elements may serve as the basis for creating a new arrangement of positioning elements by reversing an orientation of a pair of positioning elements of the existing arrangement (see FIG. 8H, where second positioning element 461 and first positioning element 416 are respectively identical to first positioning elements 410"" and 460"" visible in FIG. 8G). As seen in FIGS. 8E-8F, when the existing arrangement includes at least one pair of positioning features (for example as in FIG. 8E), reversing the orientation of the existing arrangement to create the new arrangement may also cause the orientation of the pair(s) of positioning features to be reversed (for example as seen in FIG. 8F).

It may be understood that two positioning elements are geometrically compatible with one another if it is possible to position one of them relative to a mechanical assembly and the other relative to an adaptor such that they do not interfere with engagement of the mechanical assembly and adaptor to each other. In such a case, the relative locations of the two positioning elements with respect to the mechanical assembly and adaptor may be said to correspond to one another.

The skincare device 1 as described earlier herein may be fabricated according to a process that may include providing the head 2, the handle 3, the mechanical assembly 400, and the adaptor 450.

The mechanical assembly 400 may be attached to the handle 3 and the adaptor 450 may be attached to the head 2. A first positioning element 410 may be connected to the handle 3 and a second positioning element 460 may be connected to the head 2.

The positioning elements 410, 460 connected to the head 2 and handle 3 may be geometrically compatible with one another. Moreover, a relative location of the first positioning element 410 with respect to the mechanical assembly 400 and a relative location of the second positioning element 460 with respect to the adaptor 450 may correspond to one another. As such, positioning elements 410 and 460 may correspond to one another.

As a non-limiting example, the first positioning element 410 may be connected to the mechanical assembly 400 subsequent to connecting the mechanical assembly 400 to the handle 3. Additionally or alternatively, the second positioning element 460 may be connected to the adaptor 450 subsequent to connecting the adaptor 450 to the head 2. For example, the first and/or second positioning element(s) may be connected to the mechanical assembly 400 and/or adaptor 450 by adhesion and/or welding and/or overmolding.

A user may desire to replace the head of the skincare device 1 while conserving a handle 3 of the skincare device 1. To satisfy such a desire, a process for fabricating a head 2 for the handle 3 of the skincare device 1 may be provided.

This process for fabricating the head 2 for the handle 3 of the skincare device 1 may comprise determining a first geometry and a first location on the basis of a second geometry and a second location.

The second geometry may be that of a positioning element connected to the handle 3 (directly or via the mechanical assembly 400).

The second location may be that of the positioning element connected to the handle 3 relative to the handle 3.

The process may comprise arranging a positioning element connected to the head 2 (directly or via the adaptor 450) at the first location.

The positioning element connected to the head 2 may have the first geometry. The first geometry may correspond to the second geometry, such that the positioning element connected to the head 2 is geometrically compatible with the positioning element connected to the handle 3.

The first location may be a location relative to the head 2. The first location may correspond to the second location.

As such, the positioning element connected to the head 2 and the positioning element connected to the handle 3 correspond to one another. Since the positioning elements correspond to one another, the head 2 and the handle 3 are engageable to one another.

When the positioning element connected to the handle 3 includes one or more positioning features, the second geometry may be understood to include the geometry/geometries of the positioning feature(s). Accordingly, the first geometry may be understood to include one or more geometries of positioning features which are geometrically compatible with the geometry/geometries of the positioning feature(s) of the positioning element connected to the handle 3, and which are provided at relative locations with respect to the head 2 which correspond to the relative location(s) with respect to the handle 3 of the positioning feature(s) of the positioning element connected to the handle 3.

It may be understood that, when the adaptor 450 is connected to the head 2, the first location may additionally or alternatively be a location relative to the adaptor 450. Likewise, when the mechanical assembly 400 is connected to the handle 3, the second location may additionally or alternatively be a location relative to the mechanical assembly 400. Similarly, it may be understood that, when the mechanical assembly 400 is connected to the head 2, the first location may additionally or alternatively be a location relative to the mechanical assembly 400. Likewise, when the adaptor 450 is connected to the handle 3, the second location may additionally or alternatively be a location relative to the adaptor 450. Correspondence of a location relative to the mechanical assembly 400 to a location relative to the adaptor 450 may be understood to be equivalent to correspondence of placements with respect to the connector assembly 4 that comprises the mechanical assembly 400 and adaptor 450.

As a non-limiting example, a user may provide handle information which contains and/or corresponds to the second geometry and second location. The handle information may include an identification number which allows the second geometry and second location to be retrieved from a database, for example. Additionally or alternatively, the handle information may include image data which allows an image analysis algorithm to identify the second geometry and second location, for example. As a non-limiting example, the image analysis algorithm may measure dimensions of the positioning element connected to the handle. The handle may even comprise one or more landmarks near the positioning element, relative to which the second geometry and second location may be measured.

The first geometry and first location may be stored as entries in the database which correspond to entries for storing the second geometry and second location. When a given second geometry and second location may be compatible with multiple first geometries and first locations, it may be possible for the entries for storing the second geometry and second location to correspond to multiple entries for storing the first geometry and first location.

As seen in FIGS. 5-7D, the arrangements of positioning elements for these connector assemblies 4, 4', 4" and 4'" may differ from each other such that the first positioning element of one arrangement may contact the second positioning element of another arrangement interferingly. This may allow the connector assembly as described herein to be suitable for use in multiple distinct product lines.

When non-correspondence between the first positioning element 410, 410', 410", 410'" of one product line and the second positioning element 460, 460', 460", 460'" of another product line prevent their respective mechanical assembly 400, 400', 400", 400'" and adaptor 450, 450', 450", 450'" from engaging to each other, it may be possible to render a product from one product line incompatible with a product from another product line even though the mechanical assemblies 400, 400', 400", 400'" and adaptors 450, 450', 450", 450'" used in the two product lines may match one another (for example they may be engageable to one another absent interfering contact by their respective positioning elements).

For example connector assembly 4 may represent a luxury product line, whereas connector assembly 4''' may represent a bargain product line. As seen in FIGS. 6A-6B, the mechanical assembly 400 of connector assembly 4 may be attached to a luxury handle 3, and the adaptor 450 of the connector assembly 4 may be attached to a luxury head 2, whereas the mechanical assembly 400''' of connector assembly 4''' may be attached to a bargain handle 3—, and the adaptor 450''' of connector assembly 4''' may be attached to a bargain head 2".

As seen in FIG. 6C, during insertion of mechanical assembly 400''' into adaptor 450, the protruding positioning feature 410*a'''* connected to first positioning element 410''' is made to contact the second positioning element 460 interferingly. As such, the bargain handle 3''' may be made incompatible with the luxury head 2 since the mechanical assembly 400''' and adaptor 450 cannot engage to one another.

Figure 6D:
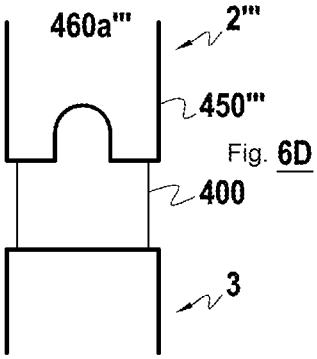
Figure 7A:
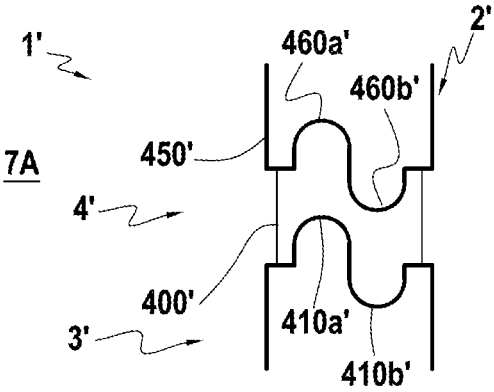
FIGS. 7A-7D show exemplary mechanical assemblies and exemplary adaptors.
Figure 7B:
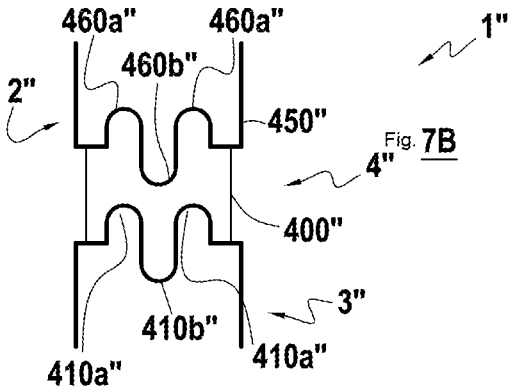
Figure 7C:
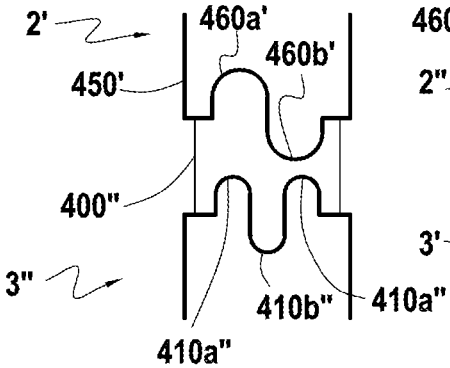
Figure 7D:
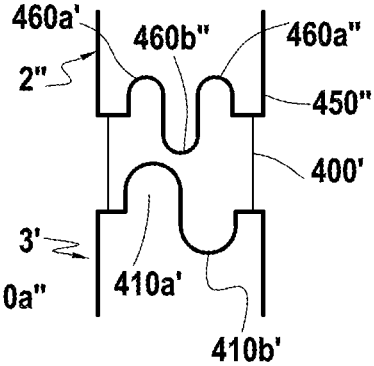

As seen in FIG. 6D, the luxury handle 3 may remain compatible with the bargain head 2''' because the first positioning element 410 and the second positioning element 460''' do not contact each other interferingly during insertion of mechanical assembly 400 into adaptor 450''', and mechanical assembly 400 and adaptor 450''' are able to be engaged to one another. Thus, the luxury handle 3 may be compatible with heads 2, 2''' from a larger range of product lines than the bargain handle 3".

It may additionally or alternatively be possible to provide mutually incompatible product lines. For example, as seen in FIGS. 7A-7D, the mechanical assembly 400' and adaptor 450' of connector assembly 4' and the mechanical assembly 400" and adapter 450" of connector assembly 4" are mutually incompatible with one another.

By providing mutually incompatible product lines, it may be possible to reduce the risk of two users inadvertently using each other's products. For example, if the first user has a handle 3' and uses a head 2' which can connect to the handle 3' by means of connector assembly 4', and the second user has a handle 3" and uses a head 2" which can connect to the handle 3" by means of connector assembly 4", then it is relatively unlikely that one user will inadvertently use the other's head 2', 2" unless s/he also inadvertently possesses the handle 3', 3" with which it is compatible.

Incompatible product lines may also allow each of a plurality of vendors to be provided with their own dedicated product lines, such that a handle from one vendor is incompatible with a head from another vendor, and/or vice versa.

As a non-limiting example, multiple product lines of a skincare device may be obtained via a process for manufacturing skincare devices 1, 1', 1", 1''' comprising fabricating a first skincare device 1, 1' as described earlier herein, and fabricating at least one second skincare device 1", 1''' as described earlier herein whose adaptor 450", 450''' matches the mechanical assembly 400, 400' of the first skincare device 1, 1' and whose second positioning element(s) 460", 460''' do(es) not correspond to the first positioning element 410, 410' of the first skincare device 1, 1'.

For example, the first skincare device 1, 1' may be provided with the first arrangement of first 410, 410' and second 460, 460' positioning elements, and the second skincare device(s) 1", 1''' may be provided with second arrangement(s) of first 410", 410''' and second 460", 460''' positioning elements.

The first and second skincare devices obtained through this process may thus share common mechanical assembly and adaptor architectures between them, while remaining incompatible with each other (be it one-way incompatibility as described with regard to FIGS. 6A-6D, or mutual incompatibility as described with regard to FIGS. 7A-7D).

Although the described embodiments were provided as different exemplary embodiments, it is envisioned that these embodiments are combinable or, when not conflicting, the features recited in the described embodiments may be interchangeable. Moreover, the features recited in the described embodiments are not inextricably linked to one another, unless such a linkage is clearly indicated between two given features.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

The invention claimed is:

1. A kit of incompatible and compatible skincare devices, comprising:

a first skin care device; and a second skin care device, wherein the first skin care device includes:

a first head and a first handle, wherein:

the first handle includes a first positioning element and a first mechanical assembly, the first head includes a second positioning element and a first adaptor, the first mechanical assembly is insertable in the first adaptor along an insertion direction, the first positioning element is geometrically compatible with and configured to engage with the second positioning element to connect the first head to the first handle, the first adaptor extends along the insertion direction towards the first head, the first mechanical assembly extends along the insertion direction from the first handle, wherein the second skin care device includes:

a second head and a second handle, wherein:

the second handle includes a third positioning element and a second mechanical assembly, the second head includes a fourth positioning element and a second adaptor, the second mechanical assembly is insertable in the second adaptor along an insertion direction, the fourth positioning element is geometrically compatible with and configured to engage with the third positioning element to connect the second head and the second handle, and the second positioning element is geometrically incompatible with the third positioning element to prevent engagement of the first head with the second handle, wherein the second positioning element includes a transverse surface of the first adaptor, the transverse surface of the first adaptor being arranged transverse to the insertion direction of the first head and the first handle, and the first mechanical assembly is configured to be inserted inside the first adaptor beyond the transverse surface of the first adaptor in the insertion direction, and the first positioning element is arranged on a peripheral surface of the first mechanical assembly and is configured to contact the transverse surface of the first adaptor to prevent further insertion of the first mechanical assembly inside the first adaptor.

2. The kit of claim 1, wherein:

the first mechanical assembly includes a first portion, the first adaptor includes a first portion and a second portion, the first portion of the first mechanical assembly is insertable into the first portion of the first adaptor, and the second portion of the first adaptor is configured to contact the first portion of the first mechanical assembly to guide the first and second positioning elements into engagement.

3. The kit of claim 2, wherein:

the second mechanical assembly includes a first portion, the first portion of the second mechanical assembly is insertable in the first portion of the first adaptor, and the second portion of the first adaptor is configured to contact the first portion of the second mechanical assembly to interfere with the second and third positioning elements.

4. The kit of claim 1, wherein:

the first handle includes a mechanical assembly housing in which the first mechanical assembly is inserted, wherein the first positioning element includes a transverse surface of the mechanical assembly housing, the transverse surface of the mechanical assembly housing being arranged transverse to the insertion direction and facing the first adaptor during insertion of the first mechanical assembly into the first adaptor.

5. The kit of claim 4, wherein the mechanical assembly housing is provided on a body of the first handle.

6. The kit of claim 4, wherein the first positioning element is bonded to or integrated with at least one of the first mechanical assembly or the mechanical assembly housing.

7. The kit of claim 1, wherein the first positioning element is geometrically incompatible with the fourth positioning element to prevent engagement of the first handle with the second head.

8. The kit of claim 1, wherein:

the first skin care device includes a first number of protruding positioning features that extend in the insertion direction in which the first handle engages with the first head and a first number of recessed positioning features, the first number of recessed positioning features provided at locations corresponding to locations of the first number of protruding positioning features, and the second skin care device includes a second number of protruding positioning features, the second number being different from the first number.

9. The kit of claim 8, wherein:

the protruding positioning features of the second skin care device are larger than the recessed positioning features of the first skin care device, the first adaptor includes a protrusion and a passageway, the first skin care device includes a transverse surface of the first adaptor, the transverse surface of the first adaptor being arranged transverse to the insertion direction and surrounding the protrusion, wherein the second positioning element extends further, in the insertion direction, than the protrusion, the first mechanical assembly is configured to be inserted inside the first adaptor beyond the transverse surface of the first adaptor, the first mechanical assembly extends further in the insertion direction than the first positioning element, the first mechanical assembly includes a recess configured to receive the protrusion, the first mechanical assembly includes a pusher configured to be inserted into the passageway to facilitate pivoting of the first head relative to the first handle, the first positioning element is arranged on a peripheral surface of the first mechanical assembly and is configured to contact the transverse surface of the first adaptor to prevent further insertion of the first mechanical assembly inside the first adaptor, the first handle includes a mechanical assembly housing in which the mechanical assembly is inserted, the first mechanical assembly includes a first portion, the first adaptor includes a first portion and a second portion, the first portion of the first mechanical assembly is insertable into the first portion of the first adaptor, and the second portion of the first adaptor is configured to contact the first portion of the first mechanical assembly to guide an engagement of the first and second positioning elements, the second mechanical assembly includes a first portion, the first portion of the second mechanical assembly is insertable in the first portion of the first adaptor, and the second portion of the first adaptor is configured to contact the first portion of the second mechanical assembly to interfere with engagement between the second positioning element and the third positioning element.

10. A kit of incompatible and compatible skincare devices, comprising:

a first skin care device; and a second skin care device, wherein the first skin care device includes:

a first head and a first handle, wherein:

the first handle includes a first positioning element and a first mechanical assembly, the first head includes a second positioning element and a first adaptor, the first mechanical assembly is insertable in the first adaptor along an insertion direction, the first positioning element is geometrically compatible with and configured to engage with the second positioning element to connect the first head to the first handle, the first adaptor extends along the insertion direction towards the first head, the first mechanical assembly extends along the insertion direction from the first handle, wherein the second skin care device includes:

a second head and a second handle, wherein:

the second handle includes a third positioning element and a second mechanical assembly, the second head includes a fourth positioning element and a second adaptor, the second mechanical assembly is insertable in the second adaptor along an insertion direction, the fourth positioning element is geometrically compatible with and configured to engage with the third positioning element to connect the second head and the second handle, and the second positioning element is geometrically incompatible with the third positioning element to prevent engagement of the first head with the second handle, wherein the first adaptor includes a protrusion, and the first mechanical assembly includes a recess configured to receive the protrusion, and the second positioning element surrounds the protrusion and extends further, in the insertion direction, than the protrusion.

11. The kit of claim 10, wherein:

the first adaptor includes a passageway, and the first mechanical assembly includes a pusher configured to be inserted into the passageway to facilitate pivoting of the first head relative to the first handle.

* * * * *